United States Patent [19]

Jacobson

[11] Patent Number: 4,946,081

[45] Date of Patent: Aug. 7, 1990

[54] APPLICATOR NOZZLE FOR SEALANT CARTRIDGES AND THE LIKE

[75] Inventor: Lawrence R. Jacobson, Midland, Mich.

[73] Assignee: Dow Corning Corporation, Midland, Mich.

[21] Appl. No.: 317,304

[22] Filed: Feb. 27, 1989

[51] Int. Cl.[5] ..... B65D 25/42

[52] U.S. Cl. ..... 222/568; 401/266

[58] Field of Search ..... 222/326, 327, 391, 541, 222/566, 567, 568, 575, 154, 156; 239/601; 401/261, 265, 266; 425/87, 458

[56] References Cited

U.S. PATENT DOCUMENTS

| | | | |
|---|---|---|---|
| 1,397,510 | 11/1921 | Grassi | 425/87 X |
| 1,866,295 | 7/1932 | Christman | 425/87 |
| 2,441,649 | 5/1948 | Sprague | 222/566 X |
| 2,664,088 | 12/1953 | Hoch | 222/575 X |
| 2,815,895 | 12/1957 | Reed | 222/568 |
| 2,930,061 | 3/1960 | O'Neil | 401/266 X |
| 3,087,654 | 4/1963 | Moore | 222/575 X |
| 3,191,809 | 6/1965 | Schultz | 222/567 X |
| 4,218,014 | 8/1980 | Tracy | 222/144.5 X |
| 4,258,884 | 3/1981 | Rogers | 239/390 |

*Primary Examiner*—Michael S. Huppert
*Attorney, Agent, or Firm*—Allan O. Maki

[57] ABSTRACT

The invention relates to a discharge nozzle for a tube of sealant materials which is provided with an aperture or slot that allows the user to monitor the rate of flow of sealant from the tube to assist in the formation of a smooth bead or fillet of sealant material when it is applied through the nozzle to a substrate.

5 Claims, 3 Drawing Sheets

APPLICATOR NOZZLE FOR SEALANT CARTRIDGES AND THE LIKE

BACKGROUND OF THE INVENTION

This invention relates generally to applicator nozzles for dispensing of sealants or pasty materials from tubes or cartridges, and more specifically to applicator nozzles from which similar sealants or similar viscous materials may be discharged and applied in the form of a fillet or smooth joint, as desired, rapidly, quickly, neatly, and consistently. Particularly, the present invention provides such a nozzle with a flow rate indicating opening which assists the applicator in applying such materials.

PRIOR ART

Previously nozzles have been provided with means for smoothing sealants, glazing compounds or the like as they are discharged from a nozzle. One example of such a device is shown in U.S. Pat. No. 2,988,775 issued to Painter et al. on June 20, 1961. In the construction shown in that patent a nozzle spout is provided having side and rear walls for confining and smoothing a glazing compound.

Another device in which smoothing wings are attached to the end of a nozzle is shown in U.S. Pat. No. 4,570,834 issued to Ward on Feb. 18, 1986. In that design the smoothing wings act to wipe the adjacent materials and to smooth the pasty material being extruded. The material can be observed coming out of the spout. However, no flow indicating a slot or aperture is provided in said design.

BRIEF SUMMARY OF THE INVENTION

The present invention provides a nozzle for discharging and smoothing sealants and other viscous or pasty materials in which an aperture is provided on the forward side of the nozzle and a smoothing means provided on the rear side of the nozzle. The construction of the present invention is characterized by the fact that the aperture is of considerably smaller diameter or area than the nozzle opening itself. The aperture is also preferably taller than it is wide in order for it to provide a controlled resistance to flow through the aperture which is less than the resistance to flow in the trailing bead formation area.

DRAWINGS

FIG. 1 is a top perspective view of a sealant tube 10 with a nozzle of the present invention 14 attached thereto, FIG. 2 is a side view of a nozzle 14 of FIG. 1, FIG. 3 is a perspective view with parts broken away, illustrating the use of a sealant dispenser of this invention, FIG. 4 illustrates another form of tube and associated dispensing nozzle with parts broken away, FIG. 5 is a frontal view of the dispensing nozzle of FIG. 4, and, FIG. 6 is a perspective view of another preferred embodiment of the invention.

DETAILED DESCRIPTION

Figure 1:
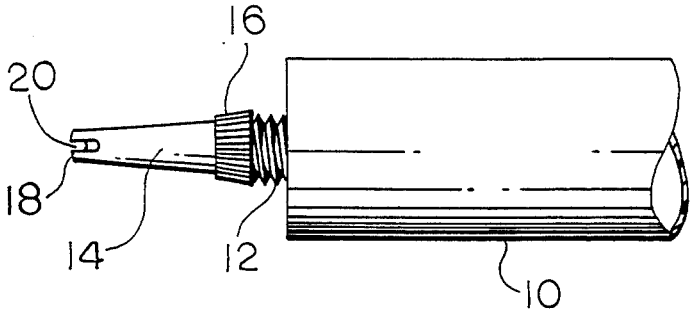

Referring more specifically to the drawings, there is shown in FIG. 1 a tube 10 which may be filled, for example, with a sealant such as a silicone or organic sealant, glazing compound, or caulking compound.

Tube 10 has an opening 12 of conventional design which may or may not be threaded. A conventional cap may be used to close the end of the nozzle. The cap may be of a frictional engagement type or be provided with mating threads depending on the design of the opening.

Figure 2:
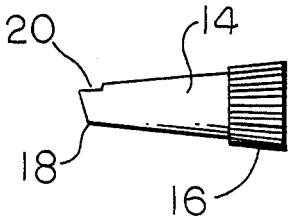
Figure 3:
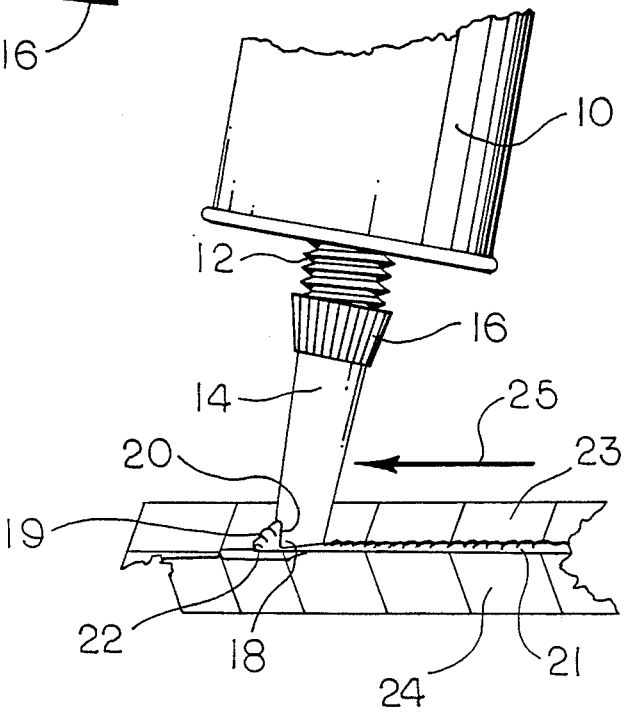

Nozzle 14 may be turned on to the threads as shown in FIG. 1 by turning threaded end 16 of nozzle 14 on to the mating threads of nozzle 12. Nozzle 14 has an opening 18 for discharge of sealant or viscous materials from tube 10. In the embodiment of FIGS. 1 and 2 the end 18 of nozzle 14 may be slanted in a rearward direction as indicated in FIG. 2. On the forward side of nozzle 14 near the tip is a slot 20 which is of an area substantially less than the area of the opening 18 in the end of nozzle 14. As seen in FIG. 3, tube 10 and nozzle 14 are cause to travel generally by hand in direction 25 to apply a bead or fillet of material 21 between substrate materials 23 and 24 which are to be either bonded together or the space between them filled with the sealant material. As the sealant material flows from nozzle opening 18 enough pressure is maintained on tube 10 to cause a small excess 22 of sealant material 19 to flow out of aperture 20. In this way the person applying the sealant has an indication of the flow rate of material out of nozzle 18. The user is thus aided in applying the sealant in a uniform, smooth bead. The fact that the opening 20 has a smaller cross sectional area than nozzle opening 18 causes the excess sealant 22 to project forward ahead of the bead being formed. This makes the flow of sealant 19 easier to see and to regulate. The forward movement of the nozzle causes that portion of the sealant which flows from the indicating slot to "roll under" and, in its entirety, rejoin the flow from the nozzle of sealant that is forming the desired bead.

Figure 4:
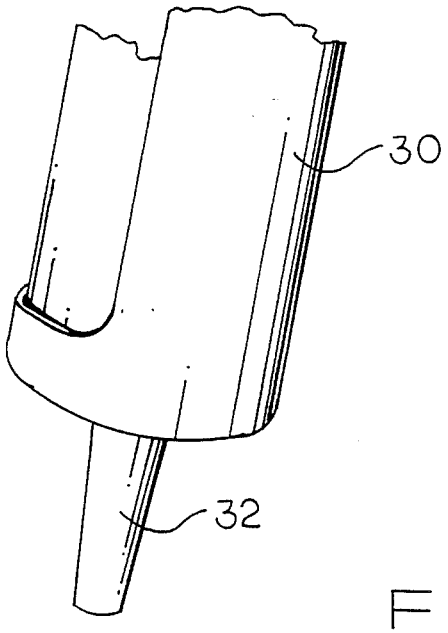
Figure 5:
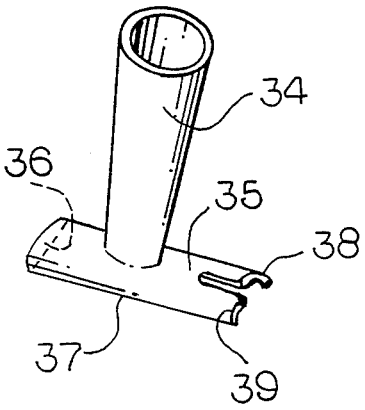
Figure 5:
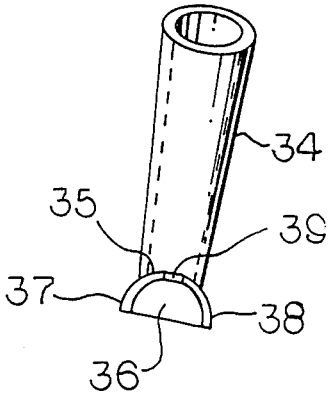

In the embodiment of the invention shown in FIGS. 4 and 5, tube 30 has a nozzle end 32 over which nozzle tip 34 is engaged by frictional fit. Nozzle end has a trowelling lip 36 at the rear thereof and similar lips 37 and 38 on each side. In this embodiment opening 39 may be formed in the top of the base portion 35 of the nozzle tip 34. In use the excess sealant will flow upward slightly out of opening 39 to provide a flow indicator of the type already described.

Figure 6:
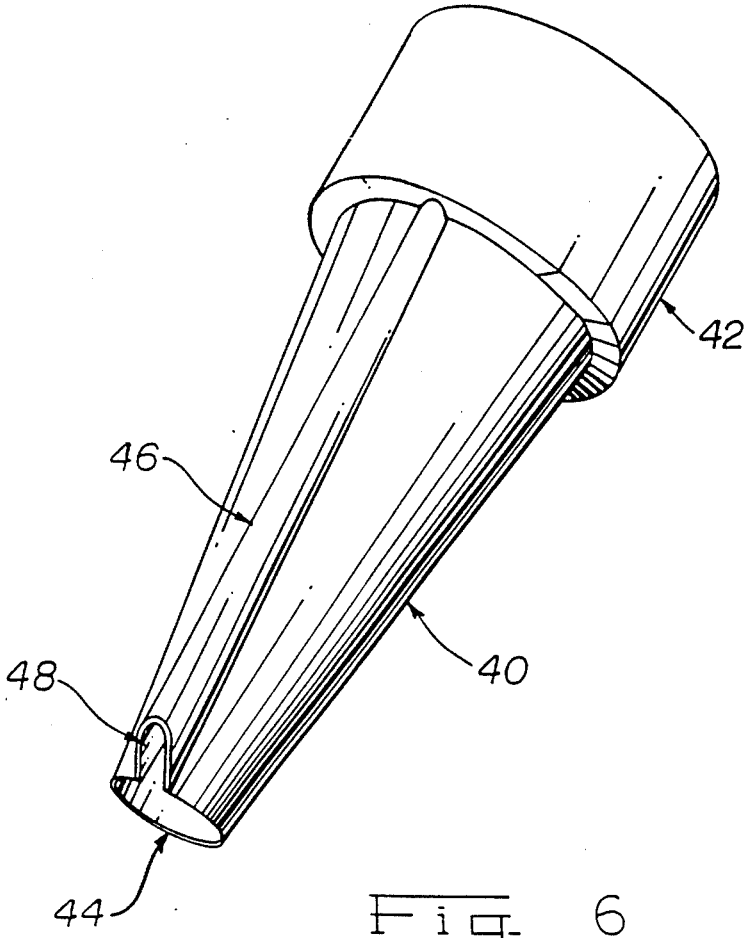

In the embodiment shown in FIG. 6 another form of nozzle is indicated generally by numeral 40. Nozzle 40 has an enlarged end 42 adapted to be attached to the discharge opening of a tube material (not shown). Nozzle 40 tapers toward the discharge end which is provided with discharge opening 44. One side of nozzle 40 is provided along its length with an enlargement or protrusion 46. The end of enlargement 46 is cut at an obtuse angle relative to that of opening 44 in order to provide a flow indicating opening 48. Opening 44 can be made perpendicular to the long axis of nozzle 40, but is preferably positioned at an angle as shown to increase the ease of use of the nozzle. Opening 48 is positioned at a more steep angle relative to such a perpendicular plane, and is preferably sloped in a direction opposite that of the periphery of opening 44.

It is generally preferred to form tube 10 and nozzles 34 or 14 out of plastic materials of conventional types currently used for dispensing tubes. Alternatively metallic materials may also be used if desired.

As noted, various viscous, pastry or similar materials may be discharged from nozzles. The particular materials used are generally well known and may be types which harden either by drying, reaction with moisture in the atmosphere, cross-linking by exposure to ultraviolet light or oxygen, etc. The particular composition used does not form a part of this invention.

Other embodiments of the invention will be apparent to those skilled in the art. For example, the opening 18 instead of being slanted in a rearward direction as shown in FIG. 2 could be either be perpendicular to the end of the nozzle 14 or could be slanted in a reverse direction in which case the tube would be pulled slightly ahead of the bead being formed.

The nozzles of the present invention may be used for application of materials to a wide variety of substrates depending on the nature of the sealant materials being dispensed. For example, the bead could be formed between two rows of tiles, in a crevice between two layers of materials such as commonly used for flooring or wall covering, for sealing window glass to a window frame, or a wide variety of other used in which crevices are desired to be sealed.

While I have described certain specific embodiments of the invention for illustrative purposes, various modifications will be apparent to those skilled in the art which do not constitute departures from the spirit and scope of the invention as defined in the appended claims.

That which is claimed is:

1. In combination, an applicator nozzle formed of an elongated, hollow tubular body having an input end fitted over the discharge spout of a tube or cartridge containing viscous sealant materials, said nozzle having a discharge opening bounded on three sides by continuous skirts, devoid of apertures, which provide for the smooth application and trowelling of said viscous material squeezed from said tube, and a forward surface in which there is a slot or aperture of substantially smaller cross-sectional area than the area of said discharge opening, whereby the user is enabled to view and monitor the amount of material being discharged from said tube or cartridge, said aperture comprising a rectangular slot having a height along an axis parallel to the body of said tube which is greater than its width.

2. A nozzle according to claim 1 wherein said discharge opening is not perpendicular to the linear axis of said nozzle.

3. A nozzle according to claim 1 wherein the tubular body of said nozzle is frusta-conically shaped and tapers toward the discharge opening.

4. In combination an, applicator nozzle formed of an elongated, hollow tubular body having an input end fitted over the discharge spout of a tube or cartridge containing viscous sealant materials, said nozzle having a protrusion along the length of one side thereof and a discharge opening at the opposite end for application and trowelling of said viscous material squeezed from said tube, the tubular body of said nozzle being frusta-conically shaped and tapering toward the discharge opening, there being a forward surface on said nozzle formed by the end of said protrusion cut at an obtuse angle relative to that of the plane of said discharge opening and of a substantially smaller cross-sectional area than the area of said discharge opening, whereby the user is enabled to view and monitor the amount of material being discharged from said tube or cartridge.

5. An applicator nozzle according to claim 4 wherein the periphery of the discharge opening lies at an oblique angle which is more nearly perpendicular to the long axis of said nozzle than is the plane of said discharge opening.

* * * * *